United States Patent [19]

Stoyanoff

[11] Patent Number: 4,571,914

[45] Date of Patent: Feb. 25, 1986

[54] SELF-FRAMING STRUCTURAL METAL RIBLATH WALL

[76] Inventor: Dimiter Stoyanoff, 1055 Ocean Blvd., SE., Stuart, Fla. 33494

[21] Appl. No.: 639,468

[22] Filed: Aug. 10, 1984

[51] Int. Cl.[4] ..... E04B 1/00

[52] U.S. Cl. ..... 52/747; 52/671

[58] Field of Search ..... 52/747, 671, 672, 663, 52/660, 670, 364

[56] References Cited

U.S. PATENT DOCUMENTS

| | | | |
|---|---|---|---|
| 670,827 | 3/1901 | White | 52/671 |
| 1,014,616 | 1/1912 | White | 52/672 |
| 1,017,255 | 2/1912 | Forsyth | 52/671 |
| 1,088,951 | 3/1914 | White | 52/672 |
| 1,112,181 | 9/1914 | White | 52/672 |
| 1,134,513 | 4/1915 | Clark | 52/672 |
| 1,309,241 | 7/1919 | Clark | 52/672 |
| 2,219,806 | 10/1940 | Buttress | 52/671 X |
| 3,872,636 | 3/1975 | Nicosia | 52/672 X |

*Primary Examiner*—Stanley N. Gilreath
*Attorney, Agent, or Firm*—Keaty & Keaty

[57] ABSTRACT

A method is disclosed for constructing a self-framing metal riblath structural wall assembly by providing an upright metal riblath having a first face facing the exterior of the structure for which the wall is being provided and a second face facing the interior of the structure. The riblath is comprised of a plurality of adjacent, substantially coplanar panels, the panels being made up of ribbed sections joined by solid, substantially v-shaped portions projecting out of the plane of the panels and being directed towards the interior of the structure. The successive panels are joined by substantially triangular offsets projecting out of the plane of the panel for joining adjacent panels, the triangular offsets being formed by bending out of the plane of the panels the section of each panel which adjoins another panel to form the triangular offset. Exterior wall material, such as stucco, is applied to the exterior wall of the riblath to provide an exterior wall therefor and for filling the triangular offset. Filling of the triangular offset provides a composite loadbearing structure within the wall that can take the place of more expensive wood or metal load bearing studs.

1 Claim, 6 Drawing Figures

SELF-FRAMING STRUCTURAL METAL RIBLATH WALL

BACKGROUND OF THE INVENTION

1. Field of the Invention

This invention concerns a method for constructing structural walls, especially self-framing structural walls not requiring steel or wooden columns for support.

2. Background of the Invention

The conventional method for constructing a structural wall includes the building of a structural metal or wood frame. This frame usually consists of vertical supports known as studs and horizontal connecting members. A conventional wallboard, such as gypsum wallboard, is then affixed to the frame to form the interior wall, and an exterior wall is formed on the other side of the studs. The space between the interior and exterior walls can conventionally be insulated.

Metal riblath is also known in the art and is sold, for example, under the trademark Milco® by INRYCO, Inc and Stay-Form TM by Alabama Metal Industries Corp. Metal riblath is often used in laying concrete to provide a structure against which concrete can adhere until it sets. Riblath is a mesh like network comprised of many small ribs having flat tops and bottoms against which stucco can set. Riblath is manufactured in many different rib configurations, the size and shape of the opening provided by the ribs varying in accordance with the type of concrete or stucco being used with it.

It is an object of the present invention to eliminate the expensive and time consuming necessity of using metal or wood studs to form the structural frame for a wall.

It is an additional object of the invention to employ metal rib lath in a novel and unconventional way to provide a structure to which stucco, or other cement like material, can be applied to form a load bearing wall.

It is a further object of the invention to provide triangularly shaped indentations in the riblath which can be filled with stucco or concrete to provide a load bearing structure in the wall that substitutes for the vertical metal or wood studs which are conventionally used.

It is an additional object of the invention, in especially preferred embodiments, to bend the riblath into corrugated configurations to provide even greater structural strength to the riblath wall.

DETAILED DESCRIPTION OF THE PREFERRED EMBODIMENTS

Figure 1:
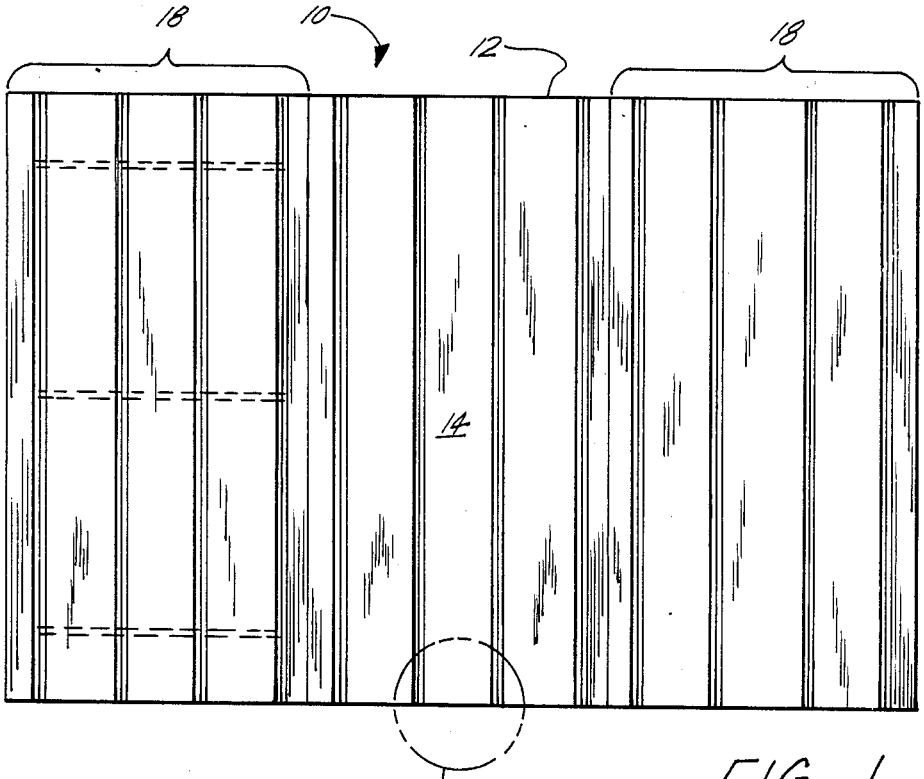
FIG. 1 is a front elevational view of three sections of metal riblath joined together for use in a load bearing wall, the ribs not being shown, horizontal bracing for preventing transverse displacement of the panels being shown in phantom.

This invention concerns a method of constructing a self-framing, structural wall 10 comprising an upright riblath 12 having a first face 14 facing the exterior of the structure for which the wall is being provided and a second face 16 facing the interior of the structure. Riblath 12 is comprised of a plurality of adjacent, substantially coplanar panels 18, the panels 18 being comprised of a plurality of ribbed sections 20, each successive section 20 being joined by a solid, substantially v-shaped portion 22 projecting out of the plane of the panels and having its apex directed towards the interior of the structure for which the wall is being provided. Successive panels 18 are joined by substantially triangular offsets 24 projecting out of the plane of panel 18 adjoining adjacent panels. The triangular offset 24 is formed by bending out of the plane of panels 18 the section of each panel which adjoins another panel to form the triangular offset 24 in which an exterior wall material 26 can be accumulated. Triangular offsets 24 are preferably located 16 inches or 24 inches apart to simulate the usual position of studs. The accumulation of exterior wall material 26 in triangular offsets 24 and v-shaped portions 22 provides a plurality of load bearing, substantially triangular, upright structures in the wall. Because of their greater size, triangular offsets 24 provide a majority of the structural support in the wall, and largely take the place of metal or wood studs.

Figure 2:
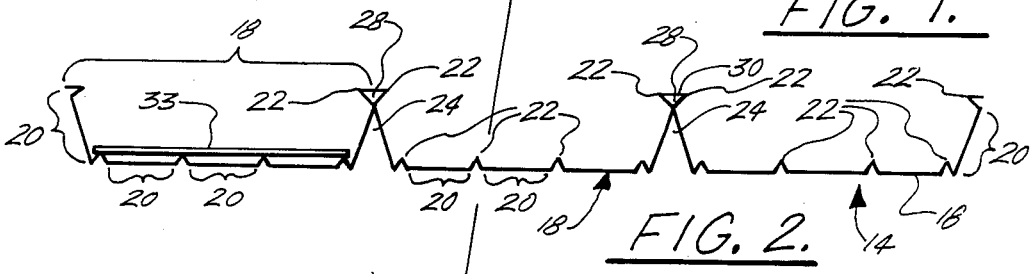
FIG. 2 is a top view of the metal riblath shown in FIG. 1.

V-shaped portions 22 which are found along the edges of successive panels 18 cooperate to form a small triangle 28 (see especially FIGS. 2 and 4), the base of small triangle 28 which is formed by the overlapping legs of successive v-shaped offsets thereby forming a flat surface 30.

An interior wall 32 (FIG. 4) is affixed to the flat surface 30 by any conventional fastening means such as nails, or screws directly to surface 30 or to horizontal runners previously secured to surface 30.

In preferred embodiments a rigid brace (rod or sheet metal) 33 is affixed to successive v-shaped portions 22 across the width of panel 18. Preferred embodiments use one to three rods on each panel: when three braces are used, a first one is fixed at the midline of the wall, an upper rod about one foot from the top of the wall, and a lower rod about one foot from the bottom of the wall. The braces are affixed to v-shaped portions 22 by any conventional means as, for example, spot welding or wire tying. These braces 33 prevent displacement of panels 18 in a horizontal direction along the plane of the panels during stuccoing or when the wall is in place.

Figure 3:
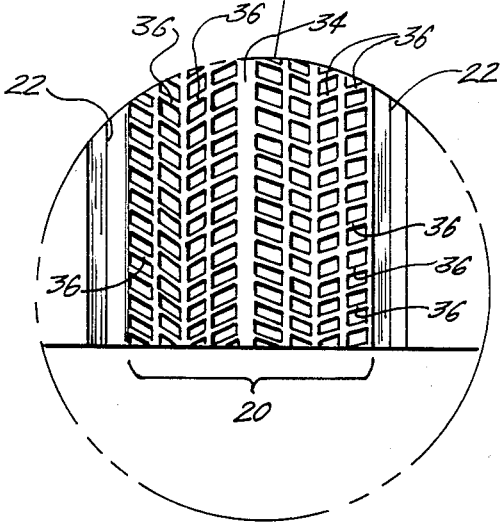
FIG. 3 is an enlarged view of a portion of the metal riblath shown in FIG. 1, the configuration of a particular kind of metal riblath being shown in detail.

Turning now to FIG. 3, the specific riblath disclosed in the present invention is shown in greater detail. The riblath is comprised of a section 20 bounded by a pair of successive v-shaped portions 22, the portions 22 shown in FIG. 3 projecting into the plane of the page. Section 20 is further comprised of a solid, flat connecting member 34, as well as a plurality of many individual ribs 36 (only a few of which are numbered in FIG. 3 for purposes of clarity). Many of the riblaths have a flat top and bottom, the planes of the flat top and bottom forming an angle with the plane of the sections 20 to provide an inclined surface against which stucco, cement or other exterior wall material can be adhered and supported.

Figure 4:
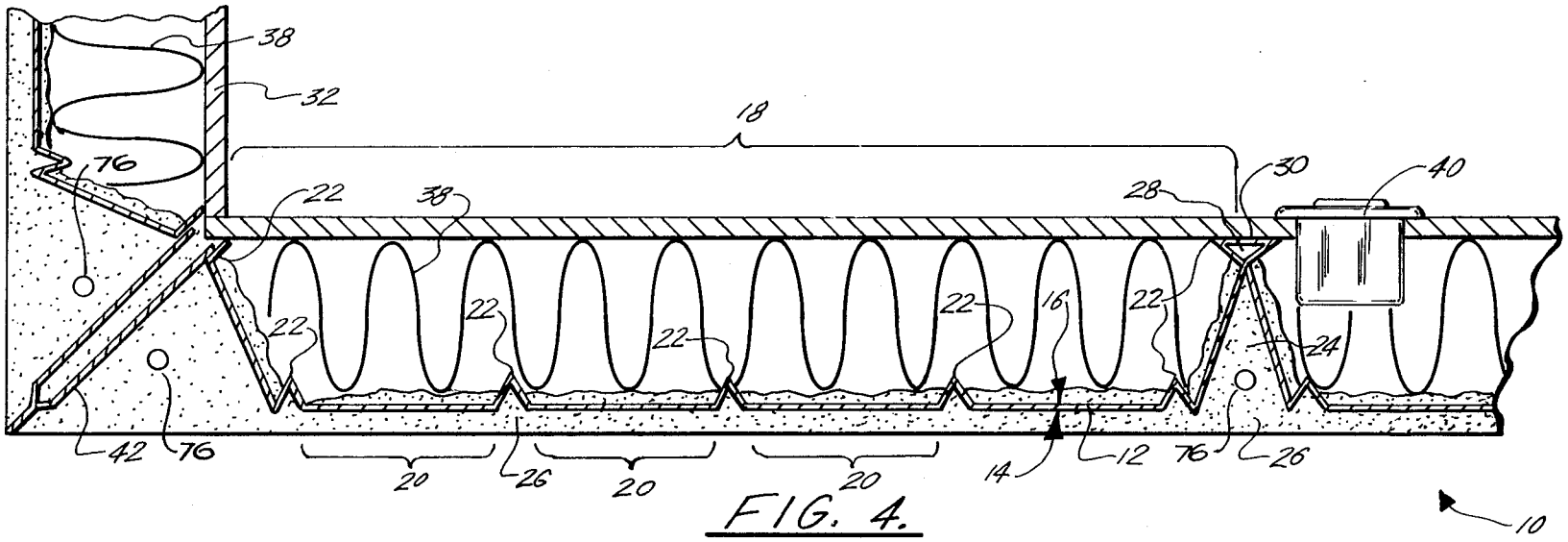
FIG. 4 is a top, cross-sectional view of a metal riblath wall installed in a structure, a gypsum board being applied to the interior of the riblath wall and stucco having been adhered to the exterior of the metal riblath wall.

As seen in FIG. 4, bat or sprayed insulation 38 can also be placed in the interior of the wall between panels 18 and interior wall 32 to prevent substantial heat loss or heat gain from one side of the wall to the other.

The space provided between panel 18 and interior wall 32 also affords room for the placement of electrical wiring and electrical boxes. An electrical outlet box 40, for example, is shown installed through interior wall 32 and projecting into the space between panel 18 and interior wall 32 (see FIG. 4).

A corner metal lath 42 is shown at the corner of the wall shown in FIG. 4. This corner metal lath provides a structure around which exterior wall material 26 can be placed and to which it can adhere. Corner metal lath 42 also provides a structure on which v-shaped portions 22 can be hooked at the corner of the structure to provide stability until exterior wall material 26 can be applied and allowed to set.

A reinforcement bar 76 is also shown in FIG. 4 to provide additional structural support in some preferred embodiments.

Figure 5:
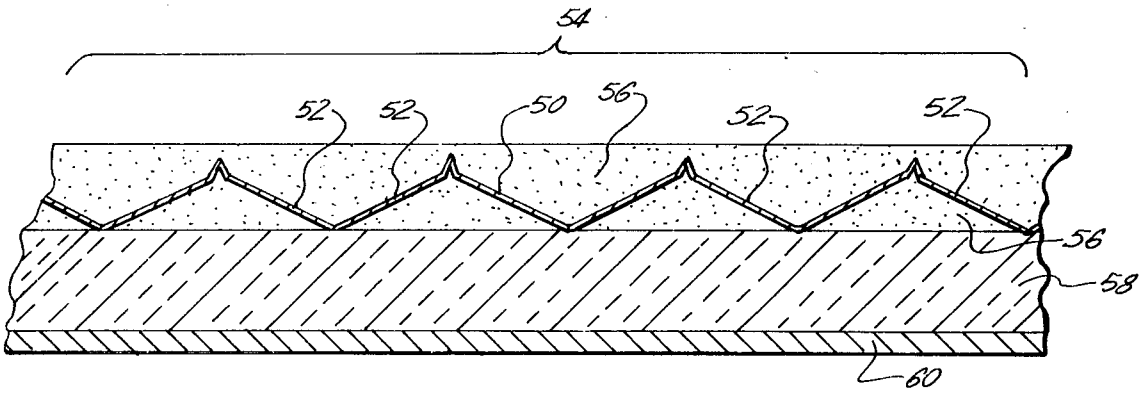
FIG. 5 is a view of a second embodiment of a metal riblath wall showing a portion of a wall or roof, succeeding sections of the riblath being bent to form corrugations for enhancing the structural strength of the riblath wall or roof.

FIG. 5 shows a second embodiment of the wall wherein a metal rib lath 50 is shown having a slightly different configuration than the riblath of the embodiment shown in FIGS. 1–4. Riblath 50 is pleated so that successive sections 52 on panels 54 of metal riblath 50 are bent at an angle to the plane of the preceding section 52, each successive bend being in the opposite direction from the preceding bend, the angles of the bends being substantially equal to provide pleats in the wall for increasing its structural integrity. Exterior wall material 56 can then be filled in on one or both sides of the pleats formed by Sections 50 to provide interlocking, complementary v-shaped sections filled with exterior wall material 56. The increased number of triangular structures formed by the exterior wall material cooperates with the superior structural strength imparted by the corrugation or pleating of the metal to yield a composite structure having great strength.

Rigid insulation 58 can be installed between exterior wall 60 and metal riblath 50 prior to stuccoing. Exterior wall 60 can be comprised, for instance, of an epoxy like coating or gypsum wallboard.

Figure 6:
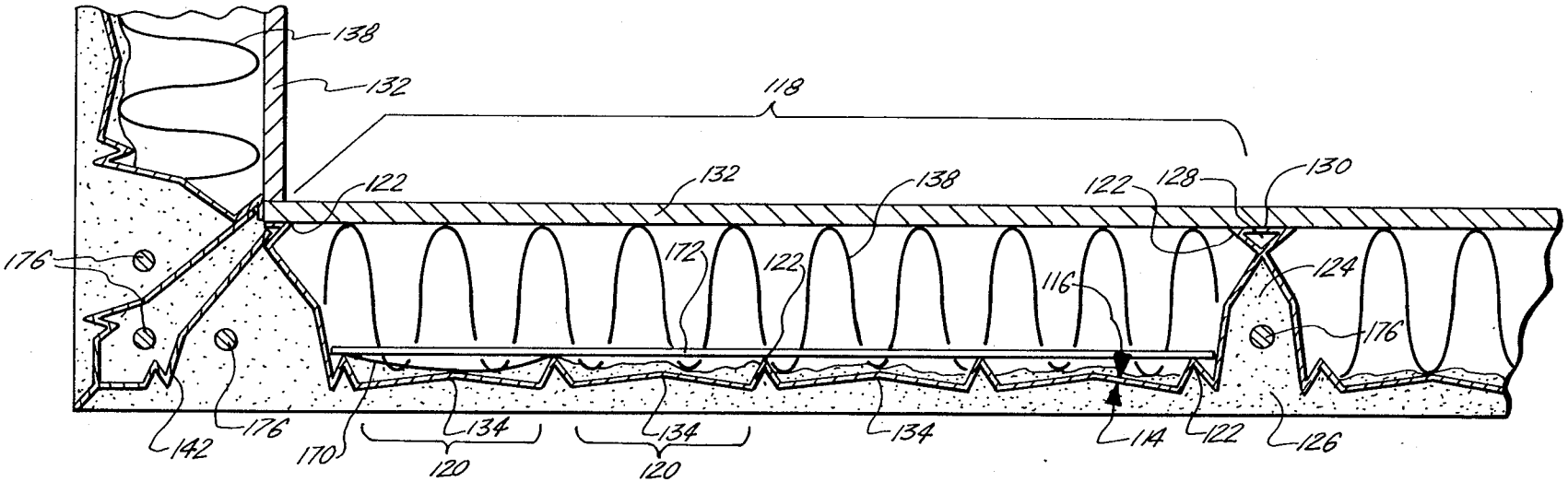
FIG. 6 is a view similar to FIG. 4 showing a third embodiment of the invention, successive sections of the riblath being bent into a somewhat corrugated configuration, and having a horizontal bracing affixed to the apices of the v-shaped offsets to prevent displacement of the wall in a horizontal direction.

Yet another embodiment of the invention is shown in FIG. 6 wherein those parts similar to the embodiment shown in FIGS. 1–4 are given the same reference numerals plus 100. The primary difference between the embodiment shown in FIG. 6 and the embodiment shown in FIGS. 1–4 is that sections 120 are bent at member 134 (cf. FIG. 3) to provide a slight coorugation in the configuration of section 120. Paper backing 170 is also provided for assisting exterior wall material 126 in not excessively seeping through the openings defined by the ribs of panels 118.

A brace 172 is also affixed to successive v-shaped offsets 122 across the width of panel 118. In preferred embodiments, three braces 172 are used (see, for example, the phantom lines in FIG. 1 showing the placement of such braces). In especially preferred embodiments, a first rod is placed at the midline of the wall, an upper rod is placed about one foot from the top of the wall, and a lower rod is placed about one foot from the bottom of the wall. The rods are affixed to v-shaped offsets 122 by any conventional means of attachment, such as spot welding or wire tying. The purpose of braces 172 is to prevent displacement of sections 120 in a horizontal direction along the plane of panels 118 when stuccoing or when the wall is in place. Without the presence of braces 172, there is a possibility that forces acting on the structure might "curl" sections 120.

Reinforcement bars 176 are also shown in FIG. 6. Such reinforcement bars can optionally be provided for use with the present invention in case additional structural strength is required or desired.

I claim:

1. A method of constructing a self-framing structural metal riblath wall, comprising:

providing an upright riblath having a first face facing the exterior of the structure for which the wall is being provided and a second face facing the interior of tthe structure, the riblath being comprised of a plurality of adjacent, substantially coplanar panels, the panels being comprised of a plurality of ribbed sections joined by solid, substantially v-shaped portions projecting out of the plane of the panels and having their apices directed toward the interior of the structure for which the wall is being provided, the successive panels being joined by substantially triangular offsets projecting out of the plane of the panel for joining adjacent panels, the triangular offset being formed by bending out of the plane of the panels the section of each panel which adjoins another panel to form the triangular offset, the apex of each triangular, load bearing offset being pointed in the direction of the interior of the structure;

applying exterior wall material to the first face of the riblath to provide an exterior wall therefor, and for filling the triangular offset and v-shaped portions to provide load bearing structure within the wall;

attaching a substantially horizontal brace to the v-shaped portions between the sections to prevent displacement of the sections in a horizontal direction when the wall is in an upright position; and attaching an interior wall to the second face of the riblath, the interior wall being fixed adjacent the apex of the triangular offset.

* * * * *